United States Patent [19]

Müller

[11] 4,394,961

[45] Jul. 26, 1983

[54] TRACK FOR TOY VEHICLES WITH JUMPING-OFF AND JUMPING-ON RAMPS

[75] Inventor: Werner Müller, Blumberg, Fed. Rep. of Germany

[73] Assignee: Helmut Darda Spielwaren- und Maschinenbau GmbH, Blumberg, Fed. Rep. of Germany

[21] Appl. No.: 113,501

[22] Filed: Jan. 16, 1980

[30] Foreign Application Priority Data

Jan. 20, 1979 [DE] Fed. Rep. of Germany ..... 2902191

[51] Int. Cl.[3] ..... A63H 18/08; E01B 23/00

[52] U.S. Cl. ..... 238/10 R; 46/1 K; 104/54; 104/55; 238/10 F

[58] Field of Search ..... 104/53–56, 104/60, DIG. 1, 69; 238/10 R, 10 A, 10 E, 10 F; 46/1 K, 216, 257

[56] References Cited

U.S. PATENT DOCUMENTS

| | | | |
|---|---|---|---|
| 770,071 | 9/1904 | Johnson | 104/55 |
| 783,812 | 2/1905 | Ancillotti | 104/54 |
| 812,595 | 2/1906 | Roberts | 104/54 X |
| 3,735,923 | 5/1973 | Brigham et al. | 104/55 X |
| 3,814,021 | 6/1974 | McHenry | 104/69 |
| 4,095,743 | 6/1978 | Birdsall | 238/10 F |

FOREIGN PATENT DOCUMENTS

| | | |
|---|---|---|
| 456401 | 2/1928 | Fed. Rep. of Germany . |
| 472333 | 2/1929 | Fed. Rep. of Germany . |
| 826863 | 1/1952 | Fed. Rep. of Germany . |
| 1905263 | 8/1970 | Fed. Rep. of Germany . |
| 2038611 | 2/1972 | Fed. Rep. of Germany . |
| 366258 | 10/1906 | France . |
| 1081918 | 9/1967 | United Kingdom . |

*Primary Examiner*—Randolph Reese

*Attorney, Agent, or Firm*—Lackenbach, Siegel, Marzullo, Presta & Aronson

[57] ABSTRACT

A track arrangement for toy vehicles with arcuately curved jump-off and jump-on ramps between which a toy vehicle can carry out a free-flying jump. The ramp tracks each have an arc between 90° and 180°, and the ramps are offset transversely to the track elongation by at least one track width. The ramps are oriented so that the tracks of the jump-on ramp is located on an extension of the trajectory of the toy vehicle, which is determined by the jump-off ramp.

10 Claims, 6 Drawing Figures

TRACK FOR TOY VEHICLES WITH JUMPING-OFF AND JUMPING-ON RAMPS

BACKGROUND OF THE INVENTION

The invention relates to a track for toy vehicles with arcuately curved jumping-off and jumping-on ramps, between which the toy vehicle carries out a jump in free flight.

Such tracks are e.g. known from German Pat. Nos. 456,401; 472,333 and 826,863.

All known constructions have in common that at the outlet end of the jumping-off ramp a mechanical arrangement is provided which furnishes to the toy vehicle that rolls along the curved track an additional turning impulse, so that the vehicle performs a somersault. If this mechanical arrangement is missing, then the vehicle initially continues its path in tangential direction, as is known in arrangement from e.g. German Published Application 2,038,611. A further characteristic of all known constructions is that the jump-off of the vehicle takes place from a ramp which is inclined counter to the travel direction through 90° relative to the horizontal.

The purpose of the invention is to so construct the jumping-off and jumping-on ramp, that the toy vehicle changes its original direction of travel by 180° and carries out the free flight between the two ramps in upside down position.

SUMMARY OF THE INVENTION

According to the present invention this problem is solved in that the ramp tracks each have an arc of curvature with an angle of arc between 90° and 180°, that the ramps are offset relative to one another transverse to the track direction by at least one track width, whereby the ramps are so oriented in per se known matter that the track of the jumping-on ramp is located on an extension of the trajectory of the toy vehicle which is determined by the jumping-off ramp.

According to the inventive proposal on the track of the jumping-off ramp is curved so far that the toy leaving the track moves through a complete looping, with a part of the looping track being traversed by the toy vehicle in free flight. To assure that in this arrangement the toy vehicle can continue its path after traversing the looping it is necessary to offset the ramps relative to one another by at least one track width.

Advantageously the tracks of the jumping-off ramp is extended approximately tangentially at its free end, whereby a better directing effect is obtained. To favor capturing, the track of the jumping-on ramp should also be extended approximately tangentially at its free end and advantageously be widened in funnel-shaped manner in this region.

According to a further proposal of the invention at least the jumping-off ramp is of flexible material, preferably a flexible synthetic plastic, with its track being deflectable transverse to the track direction.

This measure results in a substantial increase of the play possibilities. Such a jumping-off ramp can be manually adjusted by the player and thereby the flight direction of the toy vehicle can be influenced. If desired, the jumping-off ramp may be provided with means for arresting same in the desired position.

If the jumping-off ramp is to be adjustable even during the jumping-off of the vehicle, then according to a further characteristic of the invention, it is proposed to provide at the reverse side of the jumping-off ramp a handle and above the same a sighting arrangement.

In order to also influence the angle of inclination of the flight path, it is further proposed to construct the free end of the jumping-off ramp track as a flexible tongue, the angle of inclination is preferably variable by means of a slide provided on the jumping-off ramp. Sighting beads may be provided on the slide and on the flexible tongue analogous to a gun sight bead and notch or the like.

It is further possible to make the ramps adjustable in track direction, whereby the possibility is offered to adjust the jumping-on ramp to the respective flight path, in order to obtain with different vehicles and at diffent vehicle speeds optimum jump lengths at maximum reliability of function.

The inventive construction offers a new play variation if several ramp pairs, preferably two, are so arranged that the flight path determined by them crossed one another in free space. In this arrangement it is the task of the player to so start two or more vehicles successively on the track that they selectively touch each other in free flight or else traverse the flight paths unhindered.

Further structural details are subjects of the dependent claims which are not repeated here in detail.

An explempary embodiment with ramps constructed according to the invention is diagrammatically illustrated in the drawing and will hereafter be described with reference thereto. The drawing shows in:

DESCRIPTION OF THE PREFERRED EMBODIMENTS

Figure 1:
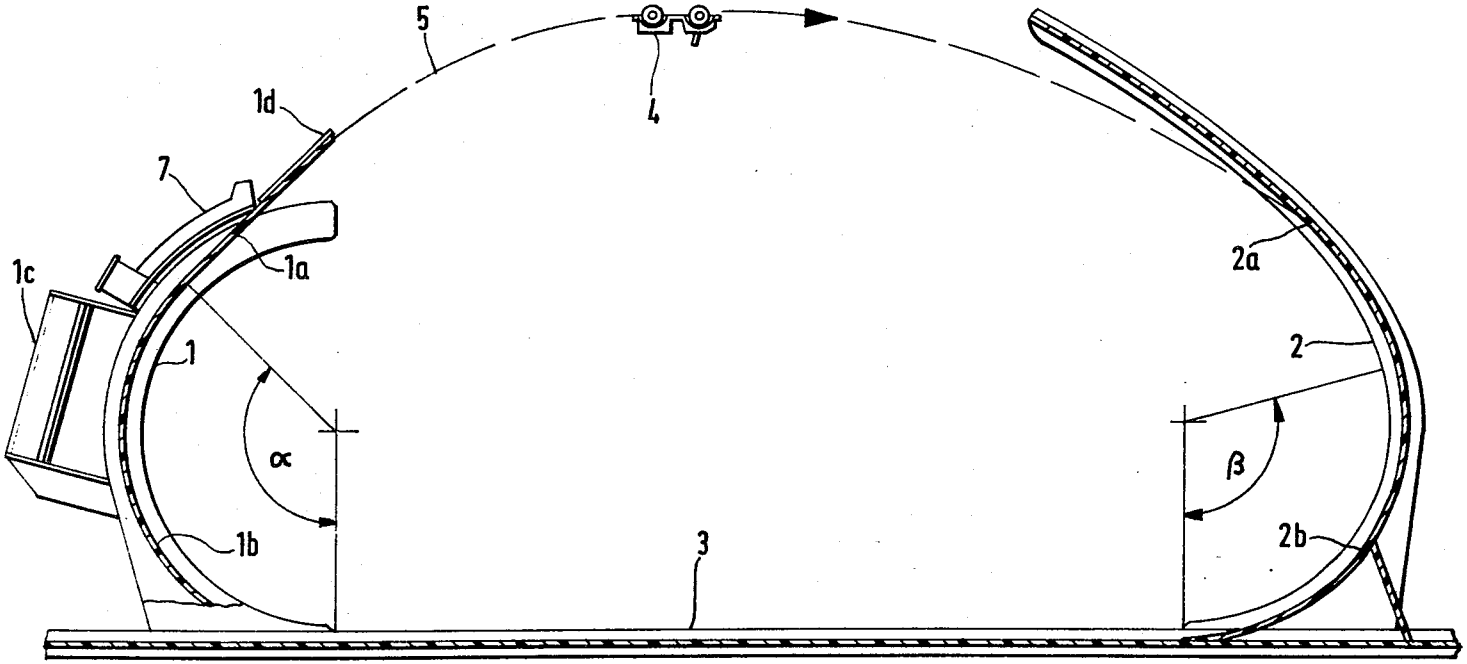
FIG. 1—a partially sectioned side view of the inventive ramp arrangement.

The illustration in FIG. 1 shows the principal construction of the inventive ramp arrangement and construction.

The planar track which, preferably in cross section, is of double-T shaped configuration, is designated generally with reference numeral 3 in all drawings, although it may be subdivided into individual track rails.

A jumping-off ramp 1 and a jumping-on ramp 2 are arranged opposite one another on two track sections which are offset by at least one track width. The track **1*b* of the jumping-off ramp 1 is arcuately curved through the angle $\alpha$, with the angle having to be between 90° and 180°. In the illustrative embodiment it is preferably 130°. At its free end the track 1*b* is tangentially extended with a track section 1*a*** which, as will hereafter be described in detail, is configurated as a flexible tongue.

Figure 5:
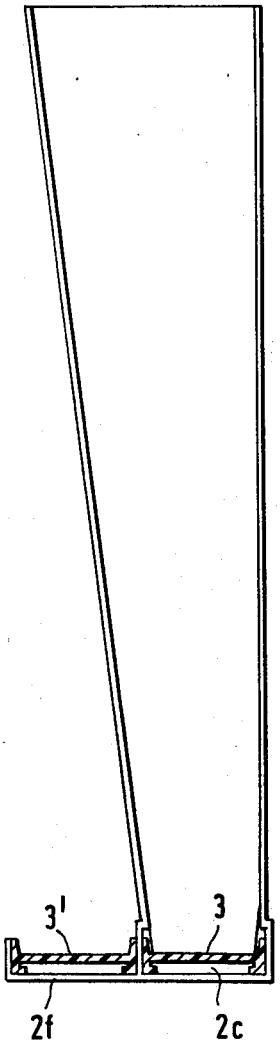

In the illustrative arrangement the toy vehicle 4 leaves the jumping-off ramp 1 approximately in upside down position, to fly through the broken-line curved flight path 5. The toy vehicle 4 is captured with the jumping-on ramp 2 which also has an arcuately curved track 2*b*, the angle of curvature again is between 90° and 180°, preferably at 130°. The free end of the jumping-off ramp 2 is also provided with a tangential extension 2*a* which advantageously is widened in funnel-shaped configuration as the illustration in FIG. 5 shows.

As shown in FIG. 1, the ramps 1 and 2 are so arranged and constructed that a vehicle reaching the inlet end of the ramp 1 performs a complete loop and, since the ramps 1 and 2 are offset relative to one another in transverse direction by at least one track width, can continue its travel on the track 3.

An essential advantage of the inventive arrangement is that the flight track 5 of the toy vehicle 4 can be influenced in many ways during the play.

Figure 2:
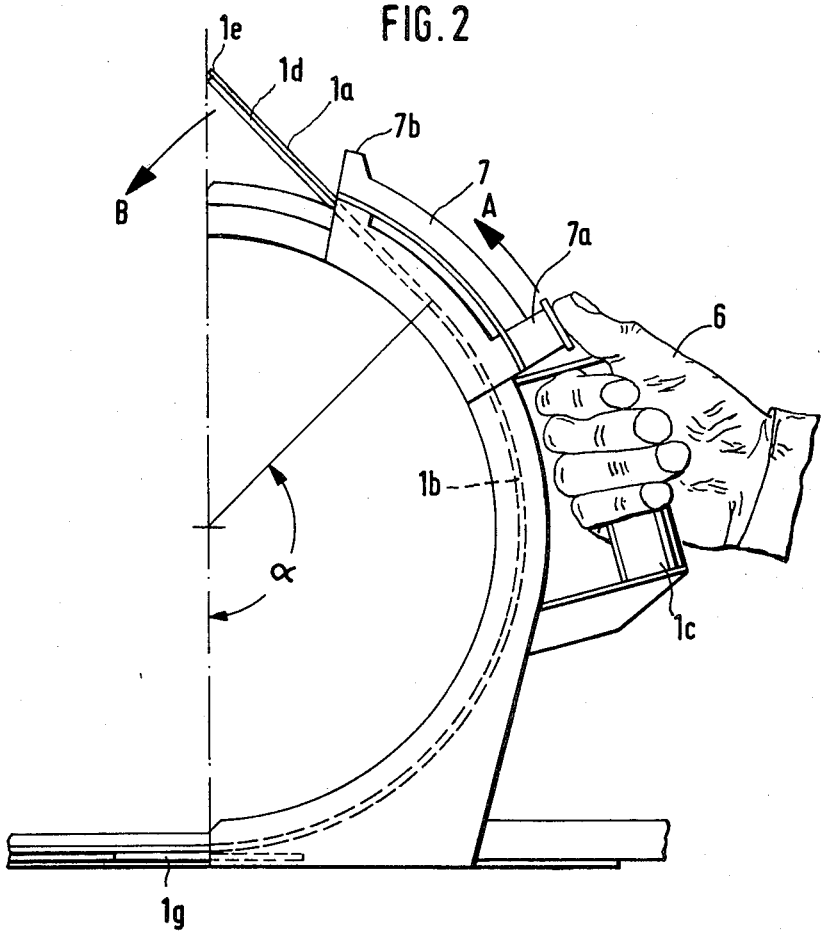
FIG. 2—an enlarged view of the other side of the jumping-off ramp 1 shown in FIG. 1, FIG. 3—a rear view of the jumping-off ramp, also a view of the ramp in FIG. 2 from the right, FIG. 4—an enlarged lateral section of the jumping-on ramp 2 of FIG. 1, FIG. 5—a front view of the jumping-on ramp, also a view of the ramp from the left in FIG. 2.
Figure 3:
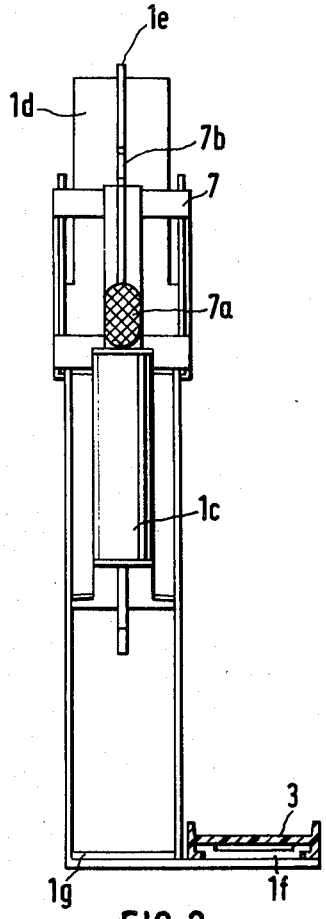

As the enlarged illustrations in FIGS. 2 and 3 clearly show, the curved track 1*b* of the jumping-off ramp terminates in a tangentially directed elastic tongue 1*d* the angle of inclination of which can be changed by means of a slide 7 provided on the ramp body 1. If the slide is shifted in direction of the arrow A then the tongue 1*d* becomes inclined in direction of the arrow B.

If the ramp track 1*b* is of a flexible material, as further proposed, then it can be pivoted in direction normal to the plane of the drawing. For this purpose handle 1*c* is provided which is to be gripped by the hand 6 of the player in the manner illustrated in FIG. 2. The slide 7 is so arranged relative to the handle 1*c* that it can be operated by the same hand via a thumb support 7*a* i.e., in one-hand operation.

In order to sight-in the jumping-off ramp in the manner of a cannon, the slide 7 and the outer end of the tongue 1*d* are provided with sighting beads 7*b* and 1*e*, by which the player can sight-in on the jumping-on ramp 2. The rear view in FIG. 3 shows the arrangement and positioning of the track rails 3. On the side which is not visible in FIG. 3 connecting tongues 1*g* are inserted into a corresponding slot onto which the supply rail can be pushed with a corresponding recess provided at the underside. The track rail 3 carrying the vehicle away from the jumping-on ramp is fixed laterally of the ramp 1 by means of a connector 1*f* of T-shaped cross section which extends into a corresponding recess at the underside of the rail.

Figure 4:
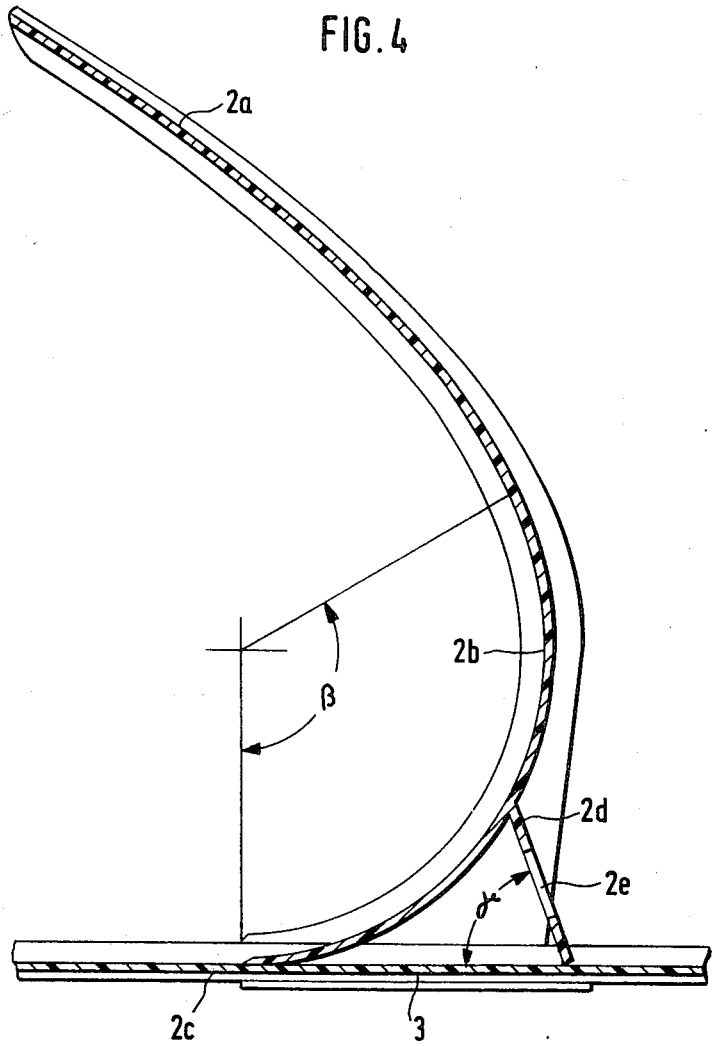

The jumping-on ramp 2 shown in FIGS. 4 and 5 is connected with the planar track rails 3 in somewhat different manner. To permit changing of the distance between the ramps 1 and 2 and thus of the length of the flight projectory 5 in simple manner, the ramp 2 is provided underneath the outlet end of the ramp track 2 with a cutout 2*c* open at both sides through which the track rail 3 can be extended. To assure that the jumping-on ramp 2 does not slowly shift lengthwise of the rail under the impact of the captured vehicles, it is supported at its rear side by means of the support 2*d* which acts as a brake when the illustrated angle $\gamma < 90°$ and so selected that self-locking occurs. If the ramp 2 is to be pulled back, the support 2*d* must be lifted off. For this purpose, it is provided with a finger hole 2*e*.

The track rail piece 3′ which extends laterally past the ramp track 2*b* is, as shown in FIG. 5, held in an upwardly open rail receiver of U-shaped cross section, so that the track rail parts 3 and 3′ cannot move transversely relative to one another.

Figure 6:
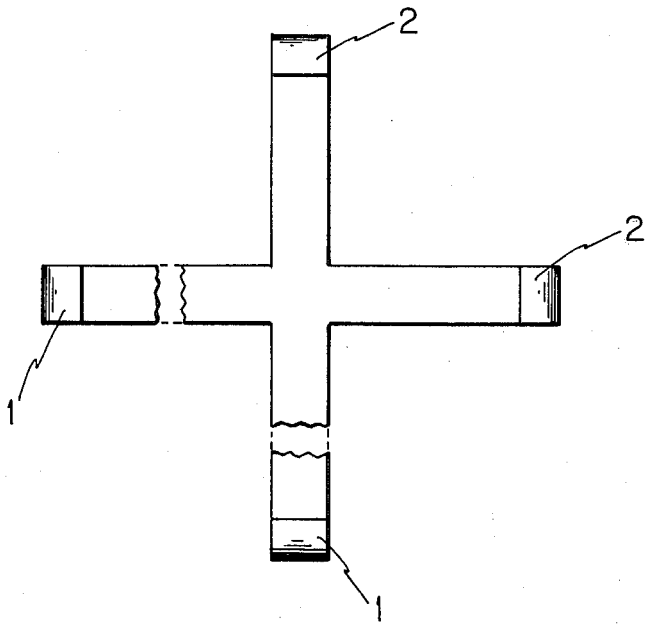
FIG. 6 is a diagramatic view of a dual ramp arrangement where the flight paths of the ramps cross over one another.

As illustrated in FIG. 6, there is shown diagramatically a very attractive play variation in which several flight tracks cross one another in the air. This arrangement is achieved in the simplest manner in that there is provided a second arrangement of ramp pairs which extend normal to the plane of the first ramp pairs.

It is to be understood that the above-described embodiments of the invention are illustrative only and that modifications thereof may occur to those skilled in the art. Accordingly, this invention is not to be regarded as limited to the embodiments disclosed herein, but is to be limited only as defined by the appended claims.

We claim:

1. A track arrangement for toy vehicles, comprising a vehicle track including arcuately curved jump-off and jump-on ramps between which a toy vehicle can carry out a free-flying jump, at least said jump-off ramp being of flexible material so as to be deflectable transversely of the track elongation, said jump-on ramp having a free-vehicle touchdown end which is wider than the remainder of said jump-on ramp, a handle at a rear side of said jump-off ramp, and a sighting device above said handle so that the jump-off ramp may be sighted-in on the jump-on ramp.

2. The arrangement of claim 1, said jump-off ramp having a free end in form of a flexible tongue.

3. The arrangement of claim 2, and further comprising a slide on said jump-off ramp and operatively connected with said tongue to vary the angle of inclination of the tongue.

4. The arrangement of claim 3, said slide being arranged above said handle and having one end provided with a thumb support and another end provided with a central sighting bead, said tongue having a free end portion provided with a sighting element which cooperates with said sighting bead.

5. The arrangement of claim 4, wherein said sighting element is another sighting bead.

6. The arrangement of claim 1, wherein said jump-on ramp is provided with means for moving said ramp lengthwise of said track.

7. The arrangement of claim 6, wherein said jump-on ramp having a vehicle-carrying surface and being provided below said vehicle-carrying surface with an open-sided cut-out in which part of said track is slidably received.

8. The arrangement of claim 7, further comprising a support for said jump-on ramp having a free end engaging said part of the track under an angle of substantially 90° relative to the intended direction of travel of the toy vehicle, so as to prevent the lengthwise shift of said jump-on ramp under the impact of the captured toy vehicle.

9. The arrangement of claim 8, wherein said support has a finger hole.

10. The arrangement of claim 1, further including a plurality of free flying jump ramps disposed in such a manner that their flight paths cross over in free space.

* * * * *